US006880474B2

(12) United States Patent
Mayers

(10) Patent No.: US 6,880,474 B2
(45) Date of Patent: Apr. 19, 2005

(54) SECTIONAL BARGE AND METHODS OF USE

(75) Inventor: Joseph Mayers, Wantage, NJ (US)

(73) Assignee: Joe Mayers Excavating, LLC, Sussex, NJ (US)

( * ) Notice: Subject to any disclaimer, the term of this patent is extended or adjusted under 35 U.S.C. 154(b) by 0 days.

(21) Appl. No.: 10/306,788

(22) Filed: Nov. 26, 2002

(65) Prior Publication Data

US 2004/0099192 A1 May 27, 2004

(51) Int. Cl.[7] ..... B63B 35/28
(52) U.S. Cl. ..... 114/26
(58) Field of Search ..... 114/26, 230.1, 114/230.13, 258

(56) References Cited

U.S. PATENT DOCUMENTS 826,421 A * 7/1906 Gilbert ..... 114/26
2,339,650 A * 1/1944 Rauch ..... 114/26
2,847,961 A * 8/1958 Meckenstock ..... 114/26
4,480,576 A * 11/1984 Mills ..... 114/230.27
4,936,238 A 6/1990 Childress ..... 114/77
5,203,271 A * 4/1993 Chapman ..... 114/26
5,479,869 A * 1/1996 Coudon et al. ..... 114/26
5,853,264 A 12/1998 Treveloni ..... 405/17
2002/0104469 A1 * 8/2002 Veazey ..... 114/65 A

OTHER PUBLICATIONS

Brzozowski–Gardener, C., "It's the Water," Pumper, Cole Publishing, Inc., Three Lakes, WI, Nov. 2001, pp. 86–87.
Declaration under 37 CFR 1.132 of Joseph Mayers regarding the experimental use of a modified sectional sea barge to deliver construction equipment and supplies to a waterfront property (3 pages).

* cited by examiner

*Primary Examiner*—Stephen Avila
(74) *Attorney, Agent, or Firm*—McCarter & English, LLP.

(57) ABSTRACT

A sectional, self-propelled barge for use in lake, island and waterfront communities for the transportation of equipment and supplies to construction sites, for example, to a site where a septic system is to be installed and methods of use thereof.

42 Claims, 5 Drawing Sheets

SECTIONAL BARGE AND METHODS OF USE

BACKGROUND OF THE INVENTION

1. Field of the Invention

The present invention relates to a sectional barge, and more particularly to a sectional barge for use in transportation of equipment and supplies to waterfront sites.

2. Related Art

In the past it has been difficult to provide construction equipment and related supplies, including septic related equipment and supplies, etc., to sites at or near waterfronts, including island and lakefront sites, because of the difficulties associated with accessing such sites. Such sites include those islands and waterfront communities which are not easily accessible by large industrial size vehicles that conventionally transport construction equipment and supplies.

One way of reaching waterfront sites is to use small vehicles that can the traverse narrow, sometimes unpaved, curved roads and right of ways leading to these sites. However, even small vehicles cannot gain access to island sites. In the past, these island sites have been accessed typically during the winter months when ice has frozen to create a bridge over which heavy construction equipment such as a bulldozer may be transported. Typically the equipment is positioned on the bank of the water, put into drive gear by an operator, who leaves the vehicle and allows it to traverse the ice unmanned. The operator can traverse the ice alongside the vehicle or in front of the vehicle. However, due to the weight of the vehicle there is the danger of the ice cracking and the vehicle sinking. This method is also dangerous because it relies on the operator re-entering the vehicle once the vehicle reaches the island.

Boats have also been used in the past to bring equipment and supplies to island or waterfront construction sites. Boats such as pontoons with a generally flat surface have been used to transport equipment and supplies to water accessible sites, but the size of such boats makes it difficult to launch them or navigate them into the smaller launch areas typical of island or waterfront construction sites.

Barges are a known way to transport construction supplies on waters. Sectional sea barges have long been used for such purposes. Such barges are moved by external vehicles such as a tug boats and the like. In the past, an unsuccessful attempt by the present inventor was made to use a modified sectional sea barge to deliver construction equipment and supplies to a waterfront site. The barge was modified by attaching a motor to the barge so it could be self-propelled. However, due to the square hull configuration of the barge, it did not operate well, and at times, the barge had to be pushed in order to begin a course of movement.

One particular problem for island and waterfront communities is the disposal of waste. Septic field construction is limited in view of the difficulty of accessing the site with the proper equipment and materials. In some island communities, septic tanks comprise 55 gallon containers that must be pumped regularly. Clearly, with such septic systems, failures are common and run off occurs regularly. Unfortunately, on such sites these are particularly vexing issues because of their proximity to the water.

Accordingly, what it needed, but has not heretofore been provided, is a sectional barge that is self-propelled and sized to be delivered to waterfront locations by vehicles of a standard size (not wide-load), which barge can be assembled, loaded and self-propelled to a location where construction equipment and supplies are to be transported. Additionally, what is needed, but has not heretofore been provided, is a method and apparatus for enabling the installation of standard and accepted septic fields on island and waterfront properties.

SUMMARY OF THE INVENTION

The present invention relates to a sectional, self-propelled barge for use in lake, island and waterfront communities for the transportation of equipment and supplies to construction sites, for example, to a site where a septic system is to be installed. The barge comprises a plurality of sections, each section sized to be loaded and transported by conventional (not wide-load) vehicles. The barge sections may be loaded and unloaded to and from a vehicle by a crane, backhoe or other suitable means. The barge sections are placed into water, where they float, and are assembled together. The barge sections are assembled in any suitable way such as by pins which are inserted through aligning apertures on brackets extending from adjacent barge sections. The forward and rear edges of the barge are raked such that the upper forward edge and the back rear edge of the assembled barge taper down to recessed bottom edges. A system for mounting one or more motors is provided at a back end of the barge. Each barge section includes a spudwell for receiving a spud that extends through the barge section to engage the bed of the water to fix the location of and stabilize the barge at locations where the barge is being loaded or unloaded. Receptacles may be provided for receiving poles for supporting an overhang for protecting people and/or equipment and supplies during inclement weather. Tie-offs may be provided on the barge sections, as well as loops for allowing lift chains to be interconnected with the barge sections. Ramps may be connected between land and the barge to facilitate loading and unloading of the barge.

BRIEF DESCRIPTION OF THE DRAWINGS

Other important objects and features of the invention will be apparent from the following Detailed Description of the Invention taken in connection with the accompanying drawings in which.

DETAILED DESCRIPTION OF THE INVENTION

Figure 1:
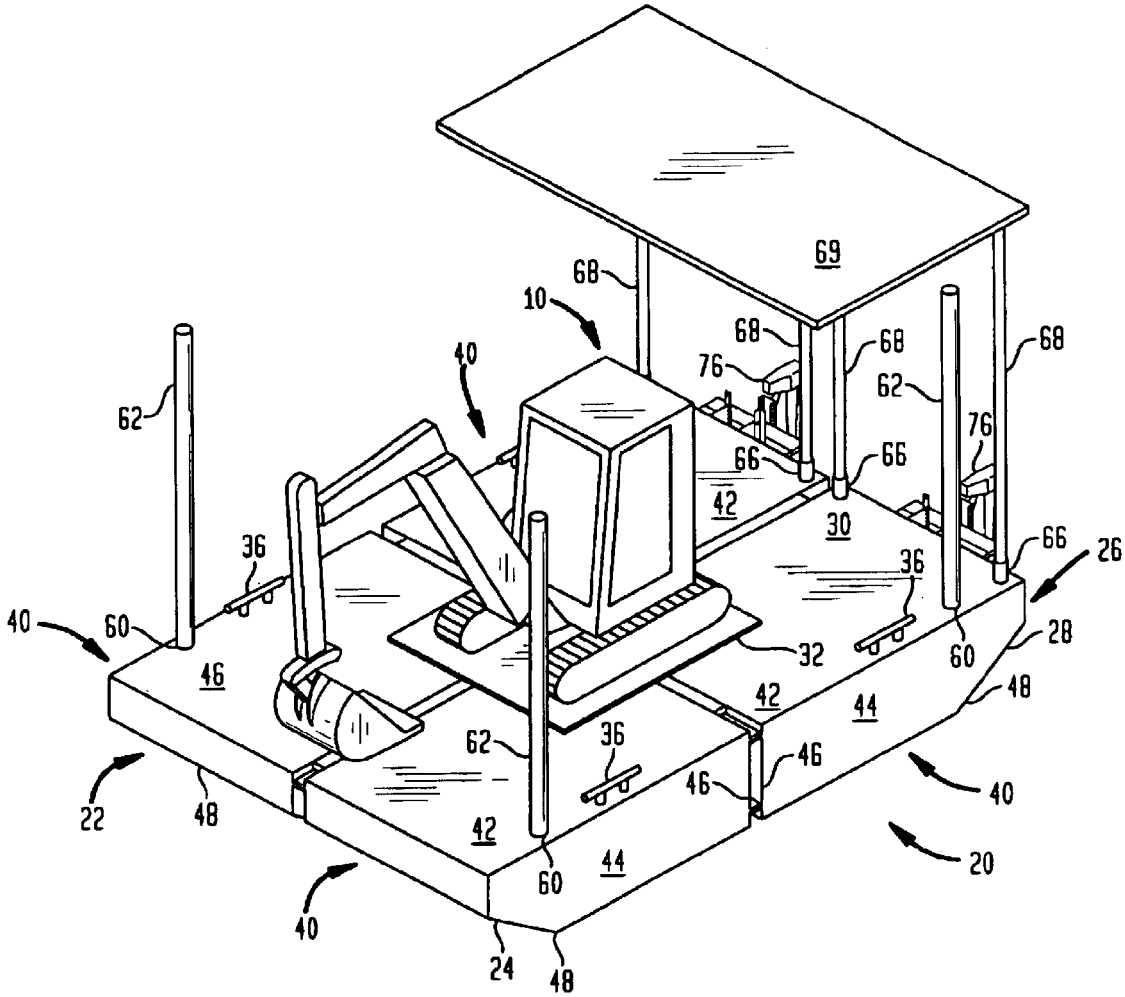
FIG. 1 is a perspective view of a loaded sectional barge of the present invention.

The sectional barge of the present invention is shown in FIG. 1. The sectional barge is generally indicated at 20 and includes a forward end 22 having a forward raked portion 24, and a back end 26 having a back raked portion 28. The barge 20 has a top working surface 30 which may have an additional surface thereon formed by plywood sheets or the like 32. The barge 20 is formed of a plurality of barge sections 40. Any number of sections may be used to create the barge. In a preferred embodiment, the barge 20 is comprised of four sections. Each section 40 of the barge 20 includes a top 42, generally flat side walls 44, a flat end 46 and a partially raked end 48.

Figure 2:
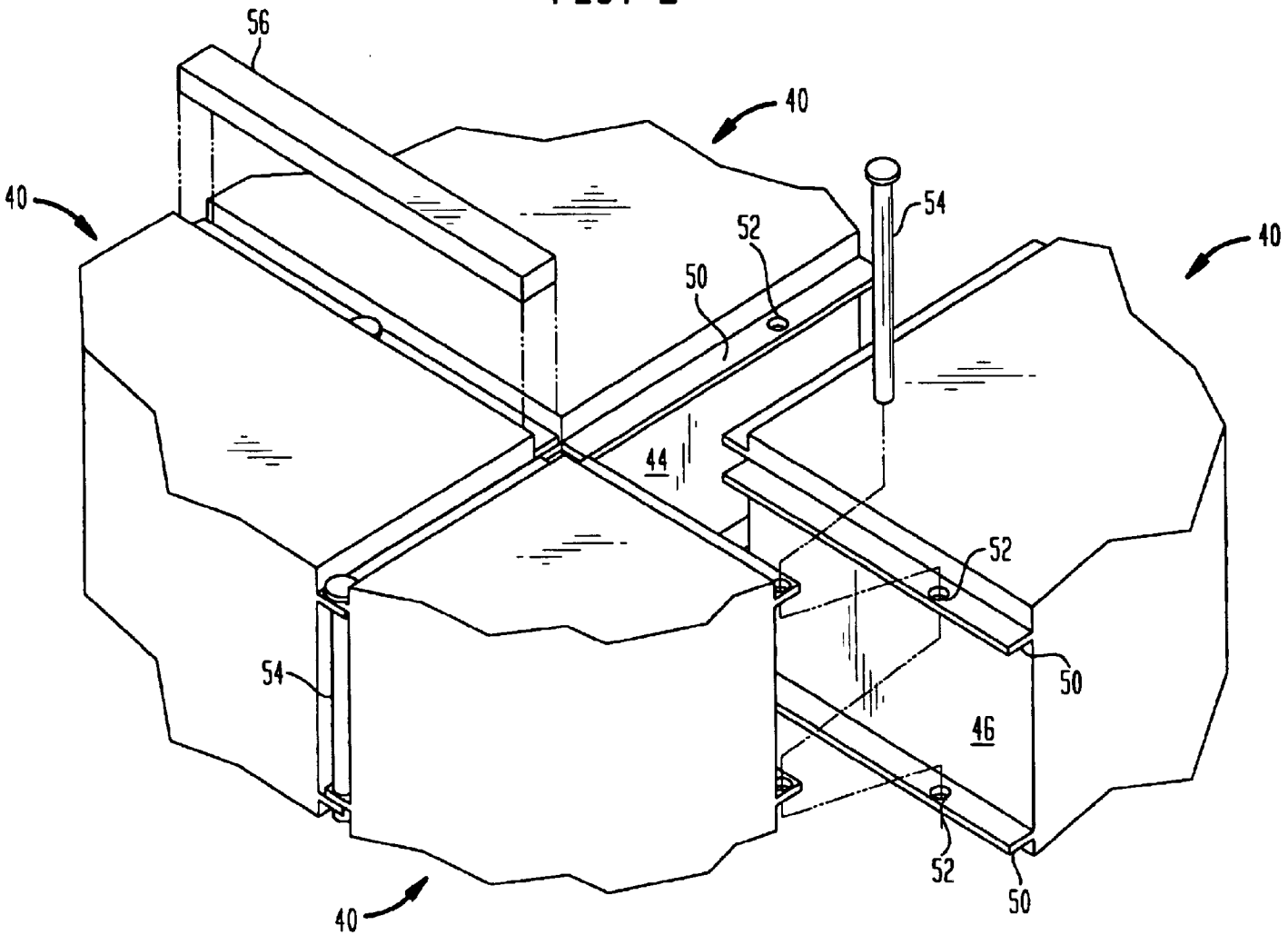
FIG. 2 is a perspective view of a portion of the sectional barge shown in FIG. 1 showing a pin and matching aperture brackets for attachment of corresponding sections of the sectional barge.

As shown in FIG. 2, each section is connected to adjacent sections by means of pins 54 that extend through apertures 52 in brackets 50 positioned on side walls 44 and flat ends 46. As shown, upper and lower brackets 50 are mounted on each side wall 44 and flat end 46. The apertures 52 and brackets 50 are aligned with the apertures 52 and brackets 50 of an adjoining section 40, and the pins 54 are inserted therethrough. Planks 56, such as two-by-four pieces of lumber may be positioned over and cover the bracket and pin engagement structure to provide a uniform top surface 30 of barge 20. Of course, other engagement mechanisms known in the art or hereinafter developed for attachment of sectional barges may be employed in fabrication of the sectional barge 20 of the present invention, and such alternate mechanisms are considered to be within the scope of the present invention.

When assembled, and when four sections are used, the barge is preferably configured to be two sections wide and two sections long. It is also preferable that raked edges are provided on front and rear edges of barge 20 in order that the barge can be brought close to a shore line for loading and unloading. It is desirable that the barge 20 include bitts 36 at various edge locations for use in tying down equipment or for securing tarps over materials, or for other purposes that may arise such as mooring the barge to a stationary object.

The size of the barge 20 can be varied by altering the size of the sections 40, and also by altering the number of sections used. The barge 20 can be increased in size by inserting two additional barge sections between forward and rearward pairs of sections to create a barge that is two sections wide and three sections long. In such an instance, the central sections would preferably be square on all sides. Alternatively, additional sections with rake sections could be utilized alongside the four barge sections shown, the additional sections having raked forward or rear edges, to form a barge of three sections in width and two sections in length.

The barge sections 40 can be formed in any way known in the art. Preferably, the barge sections are formed of hollow, air-tight metal shells. The materials and techniques for manufacturing such barge sections are known in the art. Importantly, the barge sections used in connection with the present invention are designed to be sufficiently sturdy to support construction equipment and supplies thereon. The barge sections are preferably designed to withstand travel through and to break through ice or an ice covered body of water. A further consideration in the construction of the barge sections is to provide a low draft so that the barge may be navigated through a variety of water depths. However, it is desirable that each barge section is sized so that it can be transported using conventional (not wide-load) vehicles and can be transported, maneuvered, assembled and dissembled using readily available equipment.

As shown in FIG. 1, each barge section 40 preferably includes a spudwell 60 at an outside corner thereof. The spudwell 60 comprises a passageway, typically cylindrical, through the housing of the section 40. A spud 62 can be inserted through the spudwell 60 and used to retain the barge 20 in a desired position along the shoreline of the body of water. The spud 62 extends down through the section and contacts the bottom of the body of water, thereby engaging the bottom and minimizing movement of the barge 20 with respect to the shoreline. Preferably, the spud 62 is fabricated of PVC which flexes without deforming so that the spud 62 does not become bent and locked into spudwell 60.

Additionally, it is desirable for the back edges of the rear sections of the barge 20 to include collars 66 mounted thereon for receiving support pipes 68 for supporting an overhang 69. The overhang 69 may be connected to the pipes 68 in any desirable fashion and is used to provide shelter to people or equipment during use of the barge 20. The pipes 68 can be locked into collars 66 by pins extending through apertures in the collar and aligning apertures in the pipe.

Figure 3:
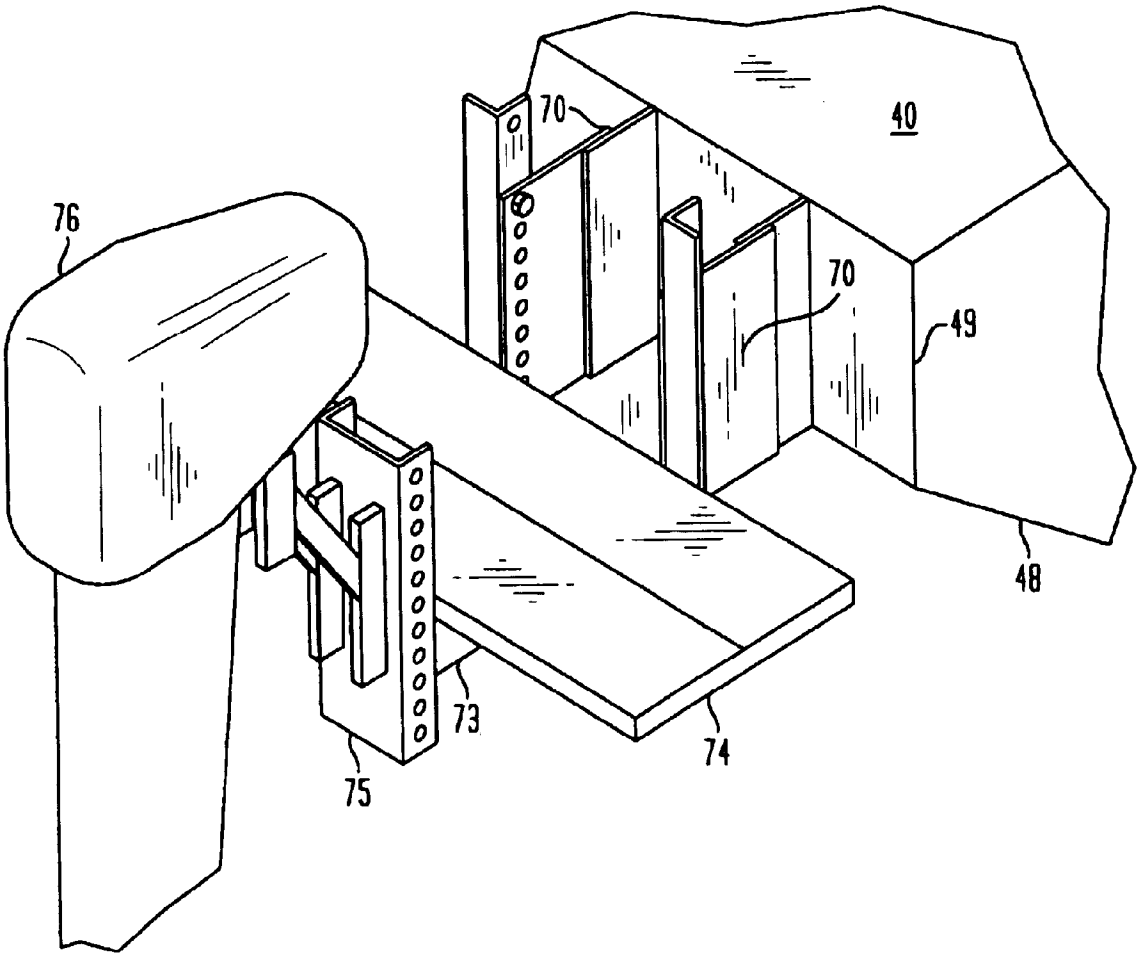
FIG. 3 is a perspective view showing the structure for attachment of a motor to a rear section of the sectional barge.

Referring now to FIG. 3, brackets 70 are provided on vertical back edge portion 49 of barge section 40. Brackets 70 may be welded to the back surface, or otherwise interconnected as is known in the art. A shelf or catwalk 74 may be interconnected therewith, and supported by rails 73. A conventional gas or electric outboard motor 76 is mounted on the shelf 74 through the use of a conventional mounting bracket 75. The motor is easily accessed and maneuvered by a person standing on the shelf Alternatively, the barge 20 can be used without a catwalk and the mounting bracket 75 will be interconnected directly with brackets 70. The motors can be used to propel the barge 20 in a forward or rearward direction as desired. The raked rear end portion of the barge section provides clearance or draft such that the motor can function well in either a forward or rearward direction. The use of a catwalk provides additional clearance for the motor. The motor mount is adjustable so the motor may be positioned at varying heights to account for the level of the barge depending on the load being carried. In some communities, where use of gas engines on a lake is prohibited, electric motors can be used in connection with the present invention. In other areas, it may be preferable to use gas engines for the power associated therewith.

Figure 4:
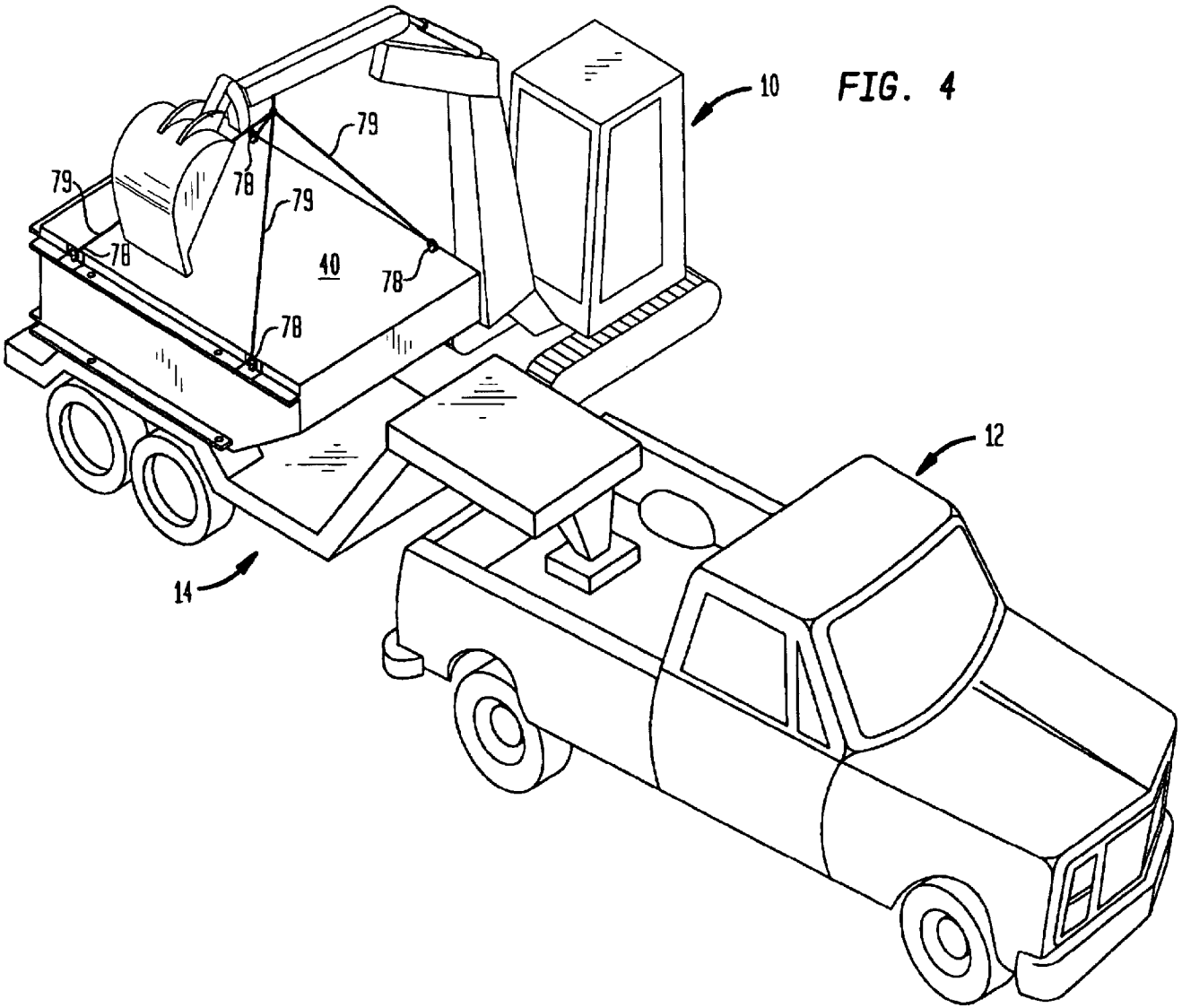
FIG. 4 shows a section of the sectional barge lifted onto a trailer attached to a conventional (not wide-load) vehicle.

As shown in FIG. 4, the section 40 is loaded on and off vehicles or trailers using a backhoe 10 or other lifting means such as cranes and the like which may be found at waterfront locations or brought in by other vehicles or the barge itself. Lift rings 78 are attached near corners of the section 40 for interconnection of lift lines 79 which are lifted by a lifting means. The lift rings are mounted by welding, or otherwise attaching, bases to which the lift rings are attached to the tops or sides of the section 40. The lift rings preferably can rotate between an upstanding position for use and an unused position where they lay down. Once a section is loaded onto the vehicle, it can be transported as desired. Because each section 40 is sized to fit on a conventional vehicle trailer, the sections may be brought into locations where traditional construction vehicles such as wide-load vehicles cannot navigate. Typically, a section is transported on a trailer 14 pulled by a pick-up truck 12 or the like.

Figure 5:
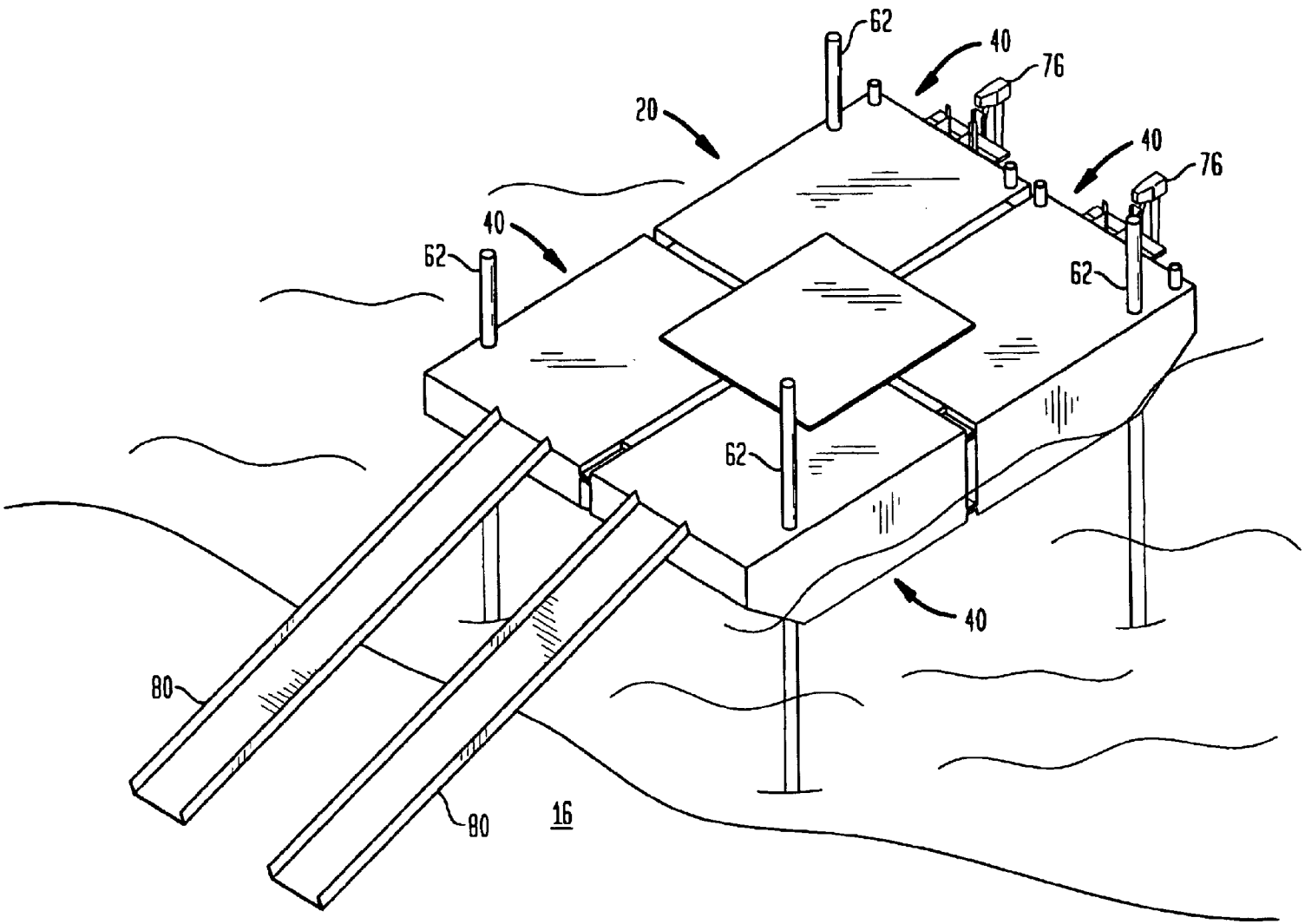
FIG. 5 is a perspective view of the sectional barge shown in FIG. 1 with spuds inserted through spudwells and planks extending between land and the barge for transfer of equipment and supplies to and from the barge.

The barge 20 as shown in FIG. 1 can be used to transport equipment or vehicles to a waterfront location. FIG. 5 shows a barge 20 positioned close to a shoreline 16. The barge 20 can be unloaded by interconnecting ramps 80 between the barge 20 and the land 16. The ramps 80 may include fingers for engagement with a lip on the barge 20 to secure attachment of the ramps 80 to the barge 20. The ramps may be further secured to the barge by chains or like means. Construction equipment can traverse the ramps 80 and can be driven off of the barge 20. Similarly, construction equipment can be driven to and from the barge to load and unload construction equipment.

The sectional barge 20 of the present invention is preferably used to transport construction equipment and materials to waterfront sites that are not easily accessible by conventional construction vehicles. For example, the barge is used to provide construction materials to islands or to remote lakefront areas. The barge is brought in sections to an assembly and launching area by conventional, non-wide load vehicles. The barge sections are unloaded from the transport vehicles using a backhoe or other lifting mechanism. The barge sections are placed into the water, assembled by aligning adjacent barge sections and inserting pins through apertures in corresponding brackets. If desired, planking can be installed in the gaps formed between the barge sections to provide a flat upper surface to the barge. The upper surface may be made even more uniform by applying a covering such as plywood sheets to the upper surface of the barge. Construction equipment is loaded onto the barge by driving the equipment from land over ramps onto the barge. The barge can be loaded with materials in any known way. The barge is then transported under its own power by motors across water to a location where the construction equipment and/or supplies are needed. The barge is brought up to the shore and spuds dropped through spudwells to retain or anchor the barge at a desired location. The ramps can be reconnected between the barge and the land to allow for loading and unloading the barge. When loading and unloading is finished, the spuds can be retracted from the spudwells, and the motors can be used in reverse to back the barge away from the shoreline. The barge can then be turned and headed back to a location for reloading or disassembly and removal from the water.

The barge of the present invention has many uses in connection with many different kinds of construction projects. One example of a construction project that is enabled by the barge of the present invention is the installation of septic tanks and fields on islands. In the past, such septic tanks have been small (on the order of 55 gallons) and require almost constant pumping. The present invention allows for a standard septic tank and field, or one approaching standard with a capacity that far exceeds the capacity of the 55 gallon container, to be installed at such locations. This provides a benefit to the homeowner, but even more importantly, provides a benefit to the environment. Because of the septic systems that can be installed by use of the barge of the present invention, the waste and the fluid is properly treated, and run off and associated septic problems are reduced, thereby benefiting the environment. However, other applications of the sectional barge disclosed herein are within the scope of the present invention.

Having thus described the invention in detail, it is to be understood that the foregoing description is not intended to limit the spirit and scope thereof. What is desired to be protected by Letters Patent is set forth in the appended claims.

What is claimed is:

1. A self-propelled sectional barge for transporting construction materials and equipment to waterfront locations comprising:

one or more forward barge sections having a tapered front wall from a forward upper end to a recessed bottom edge;

one or more rear barge sections having a tapered rear wall from a back upper end to a recessed bottom edge, wherein the barge sections are removably attachable to form a sectional barge;

a catwalk attached to the rear wall of a rear section; and an outboard motor attached to the catwalk.

2. The barge of claim 1, further comprising spudwells in the periphery of the barge sections for receiving spuds which are movable to anchor the barge at a location on a body of water.

3. The barge of claim 2, wherein the spuds are comprised of PVC tubing.

4. The barge of claim 1, further comprising bitts in the periphery of the barge sections for mooring the barge to a stationary object.

5. The barge of claim 1, further comprising receptacles along an edge of the barge section for receiving poles to support a tarp.

6. The barge of claim 1, further comprising a means for lifting the barge sections.

7. The barge of claim 6, wherein the means for lifting comprises loops integral with the edges of the barge sections.

8. The barge of claim 1, wherein the barge sections are attached by pins extended through corresponding apertures in brackets extending from adjacent side walls of the barge sections.

9. The barge of claim 1, wherein the barge sections are sized to fit on conventional transport vehicles.

10. The barge of claim 1, wherein each forward barge section further comprises flat side edges and a flat rear edge.

11. The barge of claim 1, wherein each rear barge section further comprises flat side edges and a flat front edge.

12. The barge of claim 1, further comprising a middle barge section having flat side edges and flat front and rear edges.

13. The barge of claim 1, further comprising planks inserted into gaps formed between adjacent barge sections in the assembled barge.

14. A self-propelled sectional barge for transporting construction materials and equipment to waterfront locations comprising:

one or more forward barge sections having a tapered front wall from a forward upper end to a recessed bottom edge;

one or more rear barge sections having a tapered rear wall from a back upper end to a recessed bottom edge, wherein the barge sections are removably attachable to form a sectional barge;

an outboard motor attached to the tapered rear wall of a rear section of the barge; and planks inserted into gaps formed between adjacent barge sections in the assembled barge.

15. The barge of claim 14, further comprising a catwalk attached to the rear wall of a rear section.

16. The barge of claim 14, further comprising spudwells in the periphery of the barge sections for receiving spuds which are movable to anchor the barge at a location on a body of water.

17. The barge of claim 16, wherein the spuds are comprised of PVC tubing.

18. The barge of claim 14, further comprising bitts in the periphery of the barge sections for mooring the barge to a stationary object.

19. The barge of claim 14, further comprising receptacles along an edge of the barge section for receiving poles to support a tarp.

20. The barge of claim 14, further comprising a means for lifting the barge sections.

21. The barge of claim 20, wherein the means for lifting comprises loops integral with the edges of the barge sections.

22. The barge of claim 14, wherein the barge sections are attached by pins extended through corresponding apertures in brackets extending from adjacent side walls of the barge sections.

23. The barge of claim 14, wherein the barge sections are sized to fit on conventional transport vehicles.

24. The barge of claim 14, wherein each forward barge section further comprises flat side edges and a flat rear edge.

25. The barge of claim 14, wherein each rear barge section further comprises flat side edges and a flat front edge.

26. The barge of claim 14, further comprising a middle barge section having flat side edges and flat front and rear edges.

27. A method for transporting construction equipment and supplies to a waterfront property comprising:

conveying a plurality of barge sections to an edge of a body of water, wherein each barge section has a partially tapered end, a flat end and flat sides;

placing the barge sections into the body of water;

removably attaching the barge sections to form an assembled sectional barge having a front section and a rear section;

loading construction equipment and supplies onto the assembled barge sections;

attaching a catwalk to a rear edge of one of the barge sections and an outboard motor to the catwalk; and moving the barge under motor power to the waterfront property where the equipment and supplies are to be used.

28. The method of claim 27, further comprising conveying the barge sections to an edge of a body of water using conventional transport vehicles.

29. The method of claim 27, further comprising positioning the flat ends of the barge sections together so that the tapered ends face in forward and rear directions.

30. The method of claim 27, wherein the barge sections are attached by inserting pins through apertures in brackets in adjacent ends and sides of the barge sections.

31. The method of claim 27, further comprising anchoring the barge at a location on the body of water with spuds movably inserted into spudwells in the periphery of the barge.

32. A method for transporting a septic tank and related construction equipment and supplies to a waterfront property comprising:

conveying a plurality of barge sections to an edge of a body of water, wherein each barge section has a partially tapered end, a flat end and flat sides;

placing the barge sections into the body of water;

removably attaching the barge sections to form an assembled sectional barge having a front section and a rear section;

loading the septic tank, a backhoe and related construction equipment and supplies onto the assembled sectional barge;

attaching a catwalk to a rear edge of one of the barge sections and an outboard motor to the catwalk; and moving the barge under motor power to the waterfront property where the septic tank is to be installed.

33. The method of claim 32, further comprising conveying the barge sections and septic tank to an edge of a body of water using conventional transport vehicles.

34. The method of claim 32, further comprising positioning the flat ends of the barge sections together so that the tapered ends face in forward and rear directions.

35. The method of claim 32, wherein the barge sections are attached by inserting pins through apertures in brackets in adjacent ends and sides of the barge sections.

36. The method of claim 32, further comprising anchoring the barge at a location on the water near the waterfront property with spuds movably inserted into spudwells in the periphery of the barge.

37. The method of claim 36, further comprising connecting ramps between the barge edge and the waterfront property and unloading the backhoe and septic tank from the barge onto the property.

38. A method for transporting a septic tank and related construction equipment and supplies to a waterfront property comprising:

conveying a plurality of barge sections to an edge of a body of water, wherein each barge section has a partially tapered end, a flat end and flat sides;

placing the barge sections into the body of water;

removably attaching the barge sections to form an assembled sectional barge having a front section and a rear section;

loading the septic tank, a backhoe and related construction equipment and supplies onto the assembled sectional barge;

attaching an outboard motor to the partially tapered end of one of the rear sections;

moving the barge under motor power to the waterfront property where the septic tank is to be installed;

anchoring the barge at a location on the water near the waterfront property with spuds movably inserted into spudwells in the periphery of the barge; and connecting ramps between the barge edge and the waterfront property and unloading the backhoe and septic tank from the barge onto the property.

39. The method of claim 38, further comprising conveying the barge sections and septic tank to an edge of a body of water using conventional transport vehicles.

40. The method of claim 38, further comprising positioning the flat ends of the barge sections together so that the tapered ends face in forward and rear directions.

41. The method of claim 38, wherein the barge sections are attached by inserting pins through apertures in brackets in adjacent ends and sides of the barge sections.

42. The method of claim 38, wherein the motor is attached to a catwalk which is attached to the rear edge of a rear section of the barge.

* * * * *